US010646085B2

(12) United States Patent
Vatalaro

(10) Patent No.: US 10,646,085 B2
(45) Date of Patent: May 12, 2020

(54) FLEXIBLE VACUUM NOZZLE AND NOZZLE OPENING

(71) Applicant: Nicholas Vatalaro, South Bethlehem, NY (US)

(72) Inventor: Nicholas Vatalaro, South Bethlehem, NY (US)

( * ) Notice: Subject to any disclaimer, the term of this patent is extended or adjusted under 35 U.S.C. 154(b) by 554 days.

(21) Appl. No.: 14/511,956

(22) Filed: Oct. 10, 2014

(65) Prior Publication Data

US 2015/0101637 A1 Apr. 16, 2015

Related U.S. Application Data

(60) Provisional application No. 61/889,705, filed on Oct. 11, 2013.

(51) Int. Cl.
*A47L 9/24* (2006.01)
*A47L 9/02* (2006.01)

(52) U.S. Cl.
CPC ..... *A47L 9/242* (2013.01); *A47L 9/02* (2013.01)

(58) Field of Classification Search
None
See application file for complete search history.

(56) References Cited

U.S. PATENT DOCUMENTS 2,457,908 A * 1/1949 Meyerhoefer ..... A47L 9/244 277/605
4,114,230 A * 9/1978 MacFarland ..... A47L 7/04 137/223
4,553,284 A * 11/1985 Strumbos ..... A47L 9/02 15/414
8,113,543 B1 * 2/2012 Romani ..... A01K 13/001 15/419

FOREIGN PATENT DOCUMENTS

FR 2935166 A1 * 2/2010 ..... A47L 9/242

OTHER PUBLICATIONS

English Translation FR2935166, accessed on Feb. 2018. (Year: 2010).*

* cited by examiner

*Primary Examiner* — Eric W Golightly
*Assistant Examiner* — Arlyn I Rivera-Cordero
(74) *Attorney, Agent, or Firm* — Heslin Rothenberg Farley & Mesiti PC; Kristian E. Ziegler, Esq.

(57) ABSTRACT

A flexible vacuum attachment and method of use is provided for attaching a vacuum section to a vacuum to collect debris from a surface. The vacuum attachment comprises a flexible vacuum nozzle and nozzle opening, An end of the nozzle is attachable to a connector, which is then attachable to a vacuum. The nozzle forms a tube made of flexible material with a suction end. The suction end of the nozzle has a flexible tapered opening that is radially collapsible and foldable in one or more axial directions that can conform to various shapes. The tapered opening may include a rim that extends coplanar to a vacuumable surface. The suction end is capable of beating up and down on a vacuumable surface when operated with a vacuum.

20 Claims, 3 Drawing Sheets

FLEXIBLE VACUUM NOZZLE AND NOZZLE OPENING

FIELD OF THE INVENTION

The present invention relates to a vacuum attachment and in particular a flexible vacuum nozzle and nozzle opening.

BACKGROUND OF THE INVENTION

Vacuum cleaners may be supplied with various nozzle attachments. The most common attachments include floor brushes, powered nozzles, and crevice tools. Each attachment serves a different purpose. For instance, the floor brush is mainly used to vacuum hard surfaces such as hardwood floors or tile. Powered nozzles are generally composed of hard, inflexible material and have bristles used to dig deeper into carpets and rugs to break-up the dirt and remove it from the surface. Crevice tools generally have a blade shaped inlet and are used to vacuum hard to reach crevices and corners.

There are many problems that can be associated with using nozzle attachments. For example, when cleaning a rug or mat some users take the rug outside to beat dust and debris off because vacuuming with a nozzle attachment may be too ineffective. While taking the rug outside is effective, this method requires a person to take multiple steps to clean a rug leading to additional time and energy spent on this task especially if the user intends to vacuum the rug afterwards. Another problem with nozzle attachments is that many attachments are difficult to use underneath furniture and other hard to reach areas. The orientation of the nozzle can prevent it from fully contacting the surface, which may be an inefficient use of the nozzle.

Additional example of problems associated with nozzle attachments relates to vacuuming the inside of a vehicle. Vehicles may contain many areas that need to be vacuumed such as seats, floors, and floor mats. Floor brushes meant for wood or tile are not as effective in cleaning carpeted floor mats or seats. In addition, floor brushes are difficult to operate in small crevices in a vehicle, such as between and underneath seats. Powered nozzles are better capable at cleaning both floor mats and seats, but encounter the same difficulty as floor brushes in reaching small crevices and corners due to their inflexible construction.

Using a crevice tool is beneficial in vacuuming hard to reach crevices and corners. One issue with crevice tools is that the blade inlet is thinner than other attachments. This assists the crevice tool at vacuuming corners but makes its use for vacuuming an entire vehicle or large surface area using just the crevice tool inefficient. Switching between the crevice tool and other attachments adds additional time to vacuuming. Crevice tools comprise hard plastic bodies with the blade inlet shaped to a specified angle. To get the best effectiveness from the tool, the user must hold the tool at a specific angle to allow full suction. This may be difficult to do in a small space and may also add additional time to the vacuuming process.

Thus, a need exists for a flexible nozzle that can provide efficient cleaning of large surface areas while also having the ability to vacuum hard to reach crevices and corners.

SUMMARY OF THE INVENTION

The present invention provides, in one aspect, a flexible vacuum attachment. The vacuum attachment comprises a flexible vacuum nozzle and nozzle opening. An end of the nozzle is attachable to a connector, which is then attachable to a vacuum. The nozzle forms a tube made of flexible material with a suction end. The suction end of the nozzle has a flexible angled opening that may be radially collapsible and may conform to various shapes. The angled opening includes a rim that may extend coplanar to a vacuumable surface.

The present invention provides, in a second aspect, a flexible vacuum attachment that beats a surface. The vacuum attachment comprises a flexible vacuum nozzle and nozzle opening. An end of the nozzle is attachable to a connector, which is attachable to a vacuum. The nozzle forms a tube made of flexible material with a suction end. The suction end of the nozzle has a flexible tapered opening that is radially collapsible that can conform to various shapes. The tapered opening includes a rim that extends coplanar to a vacuumable surface. The suction end is capable of beating up and down on a vacuumable surface when operated with a vacuum.

The present invention provides, in a third aspect, a method for vacuuming a surface using a flexible vacuum attachment that beats a surface. The vacuum attachment comprises a flexible vacuum nozzle and nozzle opening. An end of the nozzle is attachable to a connector, which is attachable to a vacuum. The nozzle forms a tube made of flexible material with a suction end. The suction end of the nozzle has a flexible tapered opening that can conform to various shapes. The tapered opening includes a rim that extends coplanar to a vacuumable surface. The suction end is capable of beating up and down on a vacuumable surface when operated with a vacuum. The vacuum section is used to collect debris from a vacuumable surface.

DETAILED DESCRIPTION OF THE INVENTION

In accordance with the principles of the present invention, a flexible vacuum nozzle and nozzle opening are provided.

Figure 1:
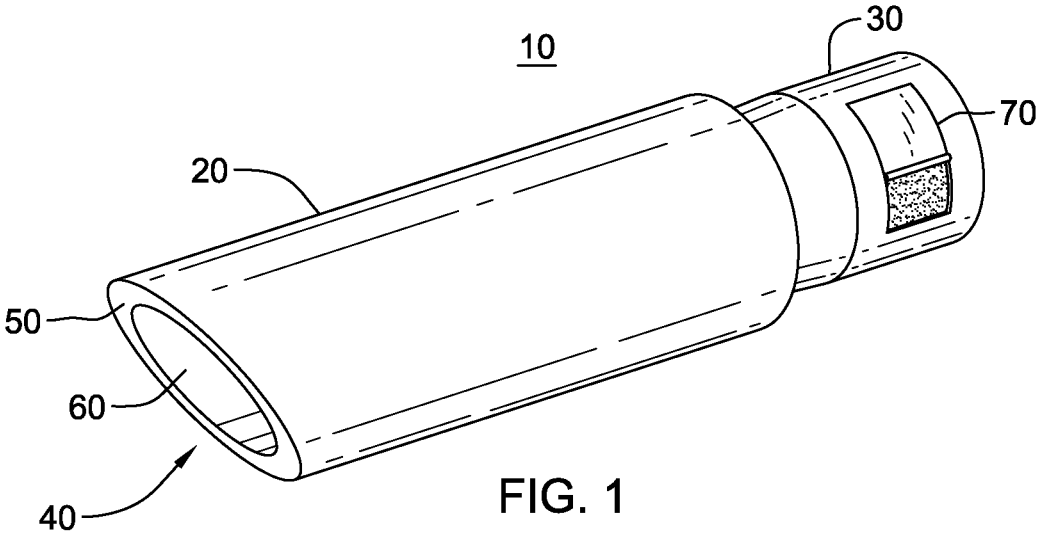
FIG. 1 is an isometric view of a flexible vacuum nozzle and nozzle opening, according to one or more aspects of the present invention.
Figure 2:
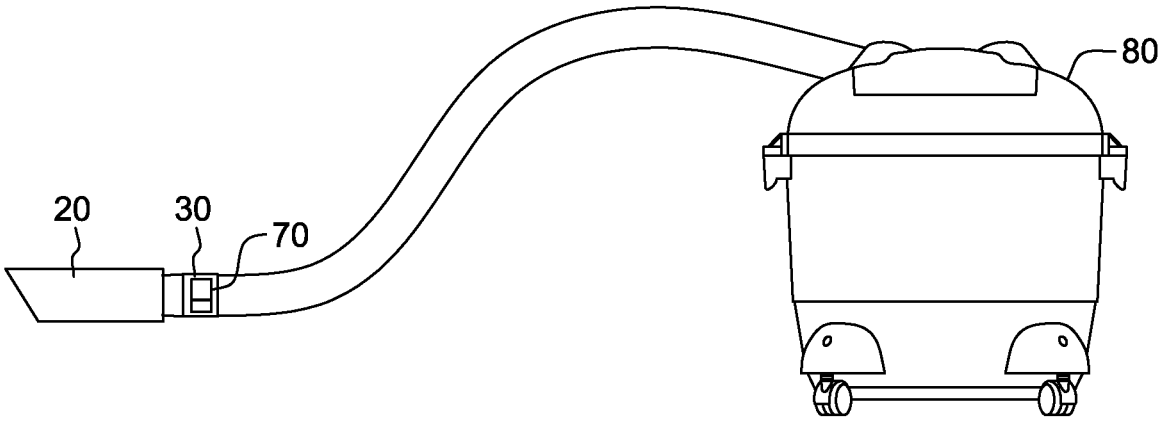
FIG. 2 is a side view of the flexible vacuum nozzle of FIG. 1 attached to a vacuum, according to one or more aspects of the present invention.

An embodiment of the present invention is depicted in FIGS. 1 and 2. The flexible vacuum nozzle 10 is shown including an end nozzle 20 attached to a connector 30. The connector 30 may be further attached to a vacuum 80, as depicted in FIG. 2. The end nozzle 20 forms a tube and may be made of a flexible material. The flexible material can be made, for example, of silicone, rubber, or another type of flexible material. In one exemplary embodiment end nozzle 20 is made of gum rubber, which may provide sufficient flexibility to end nozzle 20 while also being resistant to damage and deterioration from repeated use. The suction end 40 has a flexible angled opening 60 with a rim 50. As exemplified in FIG. 7, angled opening 60 may be radially collapsible such that the opening can conform to various shapes. As exemplified in FIG. 4, rim 50 of suction end 40 may be capable of contacting a flat vacuumable surface without a gap therebetween. Connector 30 may generally be made of a resilient or inflexible material, such as plastic. Connector 30 may also include a an adjustable opening 70 with a closure that may be adjusted to increase or decrease the size of opening 70 to adjust the suction strength of flexible vacuum nozzle 10. For example, adjustable opening 70 may including a sliding door that may be manually adjusted to open or close adjustable opening 70.

Figure 3:
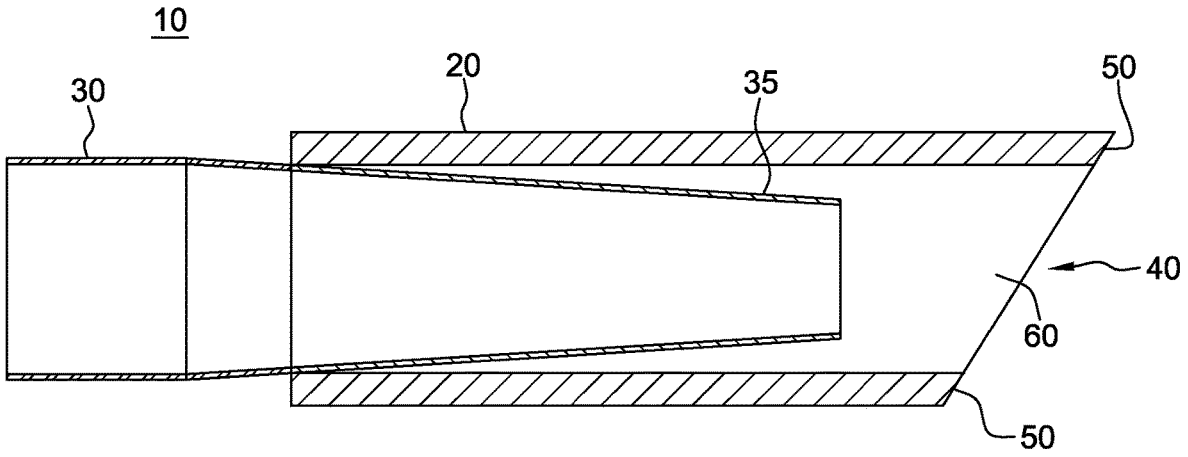
FIG. 3 is a cross-sectional side-view of the flexible vacuum nozzle of FIG. 1 showing part of the interior of the flexible vacuum nozzle according to one or more aspects of the present invention.

FIG. 3 shows a cross-sectional cutaway view of flexible vacuum nozzle 10, partially showing the interior of end nozzle 20 and connector 30. Connector 30 may have a tapered end 35 that has a narrower opening than the angled opening 60 of end nozzle 20, allowing for a gap between tapered end 35 of connector 30 and the interior walls of end nozzle 20. When flexible vacuum nozzle 10 is attached to a vacuum cleaner, the flexibility of the material of end nozzle 20 allows the force of suction through flexible angled opening 60 and tapered end 35 to make at least a portion of the rim 50 of angled end 60 beat up and down, as exemplified in FIGS. 4-5, due in part to the gap between the interior walls of end nozzle 20 and tapered end 35. In one exemplary embodiment, angled opening 60 of end nozzle 20 may have a diameter of about 1.5 inches, and tapered end 35 of connector 30 may have a diameter of about 1 inch. Connector 30 may thus have a diameter matching the diameter of angled opening 60 of end nozzle 20, so that connector 30 may fit tightly with end nozzle 20 and may fit on various models of vacuum cleaners. In such an exemplary embodiment, end nozzle 20 may have a minimum length of about 4.75 inches from end to angled opening 60 and a maximum length of about 6 inches from end to angled opening 60, so that the varying length of end nozzle 20 gives rise to angled opening 60, as illustrated in FIG. 3, and so that end nozzle 20 completely encloses tapered end 35 of connector 30. It will be appreciated by those with skill in the art that the dimensions of the exemplary embodiment described above may be altered to form flexible vacuum nozzles 10 compatible with a wide variety of vacuum cleaners. For instance, the respective diameters of tapered end 35 of connector 30 and of angled opening 60 of end nozzle 20 may be increased to allow connector 30 to fit on a Shop-Vac® or similar type of industrial vacuum cleaner.

Figure 4:
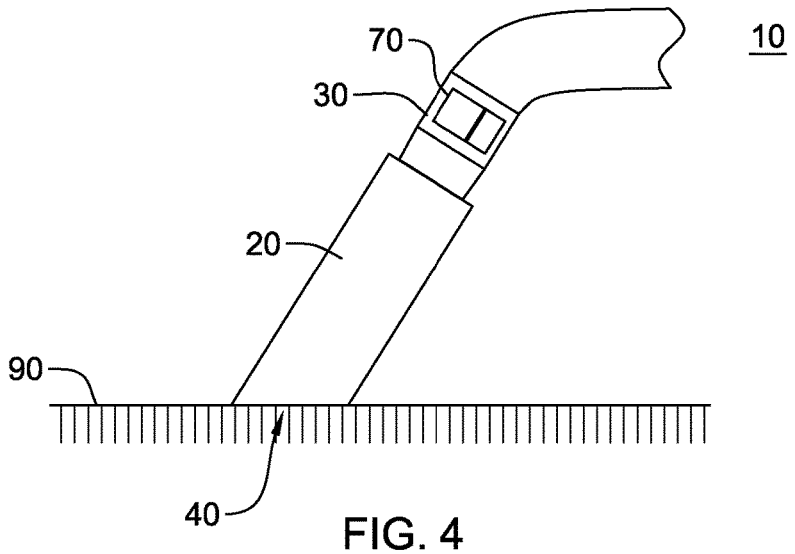
FIG. 4 is a side view of the flexible vacuum nozzle of FIG. 1 contacting a surface, according to one or more aspects of the present invention.
Figure 5:
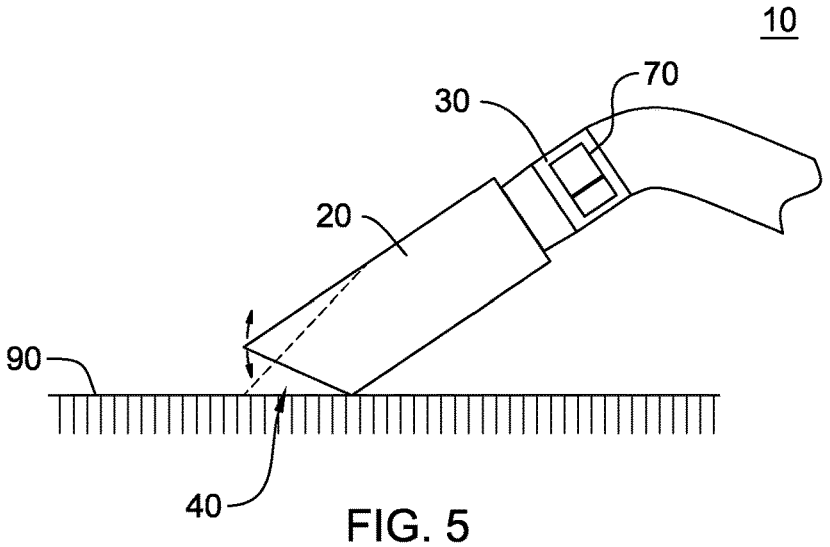
FIG. 5 is a side view of the flexible vacuum nozzle of FIG. 1 showing the up and down beating action of nozzle opening, according to one or more aspects of the present invention.

FIGS. 4 and 5 show the flexible vacuum nozzle 10 contacting a vacuumable surface 90. In FIG. 4 the suction end 40 as shown is coplanar to the vacuumable surface 90. FIG. 5 shows the movement path of the end nozzle 20 to create an up and down beating of the end nozzle 20 on the vacuumable surface 90. As described in part above, when the nozzle is attached to a vacuum cleaner, the flexibility of the material allows the force of the suction from the vacuum cleaner to make a portion of the rim 50 and angled opening 60 beat up and down. The periodic downward force of rim 50 and angled opening 60 may loosen debris from the contacted surface 90 allowing the vacuum (not depicted in FIGS. 4 and 5) to collect debris that ma be deeply embedded within a surface, such as a rug or carpet. The frequency and period of the beating may be affected by both the strength of the suction and the position of the suction end 40 in relation to the contacting surface 90. The strength of suction ma depend, in part, on the type of vacuum cleaner used. If connector 30 also includes adjustable opening 70, the strength of suction may be further increased or decreased by opening car closing said adjustable opening 70. Generally, when the suction strength is greater the frequency of the beats increases. As well, the more flexible the nozzle, the greater frequency of beats. This frequency can be greater than four beats per second. Additionally, this frequency can be greater than fifteen beats per second, or 60 90, 120, 180, or 210 beats per second.

Figure 6:
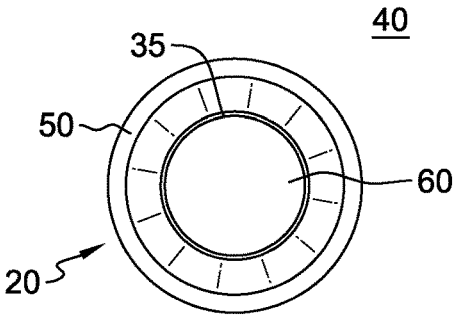
FIG. 6 is a from view of the suction end of the nozzle opening of FIG. 1, according to one or more aspects of the present invention.
Figure 7:
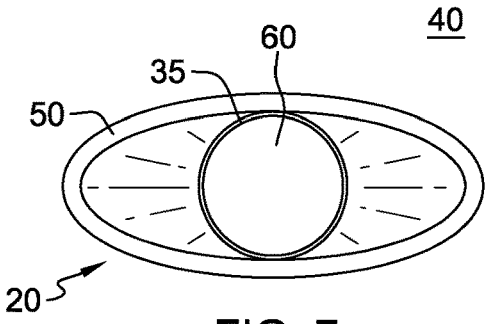
FIG. 7 is a front view of the suction end of the nozzle opening of FIG. 1 when collapsing radially, according to one or more aspects of the present invention.

FIGS. 6 and 7 show a front view of suction end 40 of end nozzle 20. In FIG. 6, the end nozzle 20 is shown with the shape of the rim 50 and angled opening 60 in a circular orientation. Tapered end 35 of connector 30 also is shown enclosed in end nozzle 20. In FIG. 7, the nozzle is shown with the shape of the rim 50 and angled opening 60 conforming to an oval orientation, for example to fit end nozzle 20 into a narrow crevice. The rim 50 and angled opening 60 of suction end 40 may be capable of radially collapsing and folding in multiple axial directions depending on the required orientation for use. Connector 30 and tapered end 35 in FIG. 7 may maintain their circular shape, as in FIG. 6, thus preventing the flexible rim 50 and angled opening 60 from completely folding shut.

Figure 8:
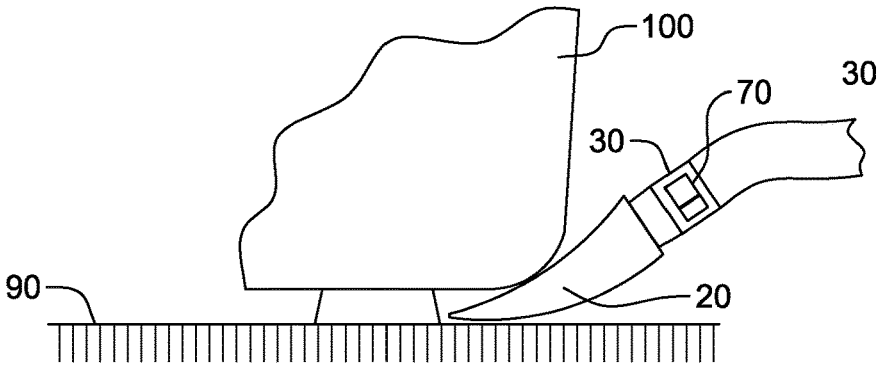
FIG. 8 is a side view of the flexible vacuum nozzle of FIG. 1 used beneath an object while contacting a surface, according to one or more aspects of the present invention.

The flexible vacuum, nozzle may also be capable of reaching hard to reach areas as shown in FIG. 8. FIG. 8 shows the flexible vacuum nozzle 10 contacting a vacuumable surface 90 while reaching underneath an object 100, such as a ear seat. To reach these hard to reach areas the flexible material allows at least a part of the angled opening 60 to conform to a different shape, such as a blade-shaped or oval-shaped inlet, as exemplified in FIG. 7, to fit into smaller or narrower areas.

The terminology used herein is for the purpose of describing particular embodiments only and is not intended to be limiting of the invention. As used herein, the singular, forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. A method for vacuuming a vacuumable surface comprising:

providing a flexible vacuum nozzle, the flexible vacuum nozzle comprising:

a connector attachable to a vacuum comprising a tapered end portion, wherein the connector is not axially compressible; and an end nozzle attached to and enclosing the tapered end portion of the connector, the end nozzle forming a non-tapered tube and comprising a flexible material comprising gum rubber, wherein the tapered end portion of the connector forms a gap extending between the end portion and the end nozzle that tapers to a junction of the connector and the end nozzle, wherein said end nozzle comprises a suction end having a flexible angled rim forming a tip portion and defining an opening, which is larger in diameter than the tapered end portion of the connector, the suction end contacting the vacuumable surface during operation of said vacuum, wherein said suction end is formed of said flexible material, and said flexible material and said gap are configured such that a suction force of said vacuum causes the tip portion of the rim to move in a beating motion comprising a downward motion into contact with the vacuumable surface and an upward motion away from the vacuumable surface, and wherein the flexible angled opening and rim are configured to extend coplanar to said vacuumable surface when the rim is in contact with the vacuumable surface; attaching said connector to a vacuum; and operating said vacuum using said flexible vacuum nozzle to collect debris from a vacuumable surface.

2. The method of claim 1, wherein said beating motion is non-continuous.

3. The method of claims 1, wherein the flexible angled opening is radially collapsible and foldable in one or more axial directions.

4. The method of claim 1, wherein the connector further includes an adjustable opening with a closure adjustable to increase or decrease a suction strength of the vacuum.

5. The method of claim 1, wherein the beating motion repeats at a frequency, the frequency of beats being, at least in part, a function of the suction force of said vacuum.

6. The method of claim 5, wherein the frequency of beats is further a function of a flexibility of the flexible material of the end nozzle.

7. The method of claim 5, wherein the frequency of the beating motion is of more than 4 beats per second.

8. A structure comprising:

a flexible vacuum nozzle comprising:

a connector attachable to a vacuum comprising a tapered end portion, wherein the connector is not axially compressible; and an end nozzle attached to and enclosing the tapered end portion of the connector, the end nozzle forming a non-tapering tube and comprising a flexible material comprising gum rubber, wherein the tapered end portion of the connector forms a gap extending between the end portion and the end nozzle that tapers to a junction of the connector and the end nozzle, wherein said end nozzle comprises a suction end having a flexible angled rim forming a tip portion and defining an opening, which is larger in diameter than the tapered end portion of the connector, the suction end being capable of contacting a vacuumable surface, wherein said suction end is formed of said flexible material, and said flexible material and said gap are configured such that a suction force of said vacuum causes the tip portion of the rim to move in a beating motion comprising a downward motion into contact with the vacuumable surface and an upward motion away from the vacuumable surface, and wherein the flexible angled opening and rim are configured to extend coplanar to said vacuumable surface when the rim is in contact with the vacuumable surface.

9. The structure of claim 8, wherein said beating motion is non-continuously.

10. The structure of claim 8, wherein said beating motion is periodic.

11. The structure of claim 8, wherein said beating motion is non-periodic.

12. The structure of claim 8, wherein said suction end is capable of contacting said vacuumable surface without gap between the vacuumable surface and the rim of said suction end.

13. The structure of claim 8, wherein the connector further includes an adjustable opening with a closure adjustable to increase or decrease a suction strength of the vacuum.

14. The structure of claim 8, wherein the connector is axially and radially inflexible.

15. The structure of claim 8, wherein the tip portion of the rim comprises the distal most portion of the suction end.

16. The structure of claim 8, wherein the flexible angled opening is radially collapsible and foldable in one or more axial directions.

17. The structure of claim 16, wherein the flexible material facilitates radially collapsing and folding the flexible angled opening to conform to various shapes.

18. The structure of claim 8, wherein the beating motion repeats at a frequency, the frequency of beats being, at least in part, a function of the suction force of the vacuum.

19. The structure of claim 18, wherein the frequency of beats is further a function of a flexibility of the flexible material of the end nozzle.

20. The structure of claim 18, wherein the frequency of the beating motion is of more than 4 beats per second.

* * * * *